US010492629B1

(12) United States Patent
Cunningham

(10) Patent No.: US 10,492,629 B1
(45) Date of Patent: Dec. 3, 2019

(54) REFRIGERATOR

(71) Applicant: Danby Products Limited, Guelph (CA)

(72) Inventor: Bryan Stuart Cunningham, Kitchener (CA)

(73) Assignee: DANBY PRODUCTS LIMITED, Guelph (CA)

( * ) Notice: Subject to any disclaimer, the term of this patent is extended or adjusted under 35 U.S.C. 154(b) by 621 days.

(21) Appl. No.: 15/178,654

(22) Filed: Jun. 10, 2016

Related U.S. Application Data

(60) Provisional application No. 62/175,537, filed on Jun. 15, 2015.

(51) Int. Cl.

| | |
|---|---|
| ***F25B 21/02*** | (2006.01) |
| ***A47F 3/04*** | (2006.01) |
| ***F25D 25/02*** | (2006.01) |
| ***F25D 27/00*** | (2006.01) |
| ***A47F 3/06*** | (2006.01) |
| ***F25D 23/02*** | (2006.01) |

(52) U.S. Cl.
CPC ..... *A47F 3/0434* (2013.01); *A47F 3/06* (2013.01); *F25B 21/02* (2013.01); *F25D 23/028* (2013.01); *F25D 25/02* (2013.01); *F25D 27/00* (2013.01); *F25D 2323/024* (2013.01)

(58) Field of Classification Search
CPC .... A47F 3/0447; A47F 3/0439; A47F 3/0443; F25D 2317/065; F25D 23/023; F25D 2317/0651; F25D 2317/0664; F25D 19/00; F25D 11/02
USPC ..... 312/257.1, 401, 330.1, 351.1, 334.1, 312/334.7; 248/678, 341.01
See application file for complete search history.

(56) References Cited

U.S. PATENT DOCUMENTS

| | | | | |
|---|---|---|---|---|
| 2012/0304667 | A1* | 12/2012 | Shin | F25B 21/02 62/3.6 |
| 2014/0320040 | A1* | 10/2014 | Katu | F25D 27/00 315/292 |
| 2015/0260443 | A1* | 9/2015 | Lee | F25D 23/02 312/404 |
| 2015/0260447 | A1* | 9/2015 | Kim | F25D 27/005 312/405 |
| 2017/0131024 | A1* | 5/2017 | Kempfle | F25D 23/066 |
| 2017/0211874 | A1* | 7/2017 | Kim | G01H 1/00 |

* cited by examiner

*Primary Examiner* — Henry T Crenshaw
*Assistant Examiner* — Kamran Tavakoldavani
(74) *Attorney, Agent, or Firm* — Ralph E. Jocke; Colin P. Cochran; Walker & Jocke

(57) ABSTRACT

A refrigerator (10) includes a housing (12) having an opening (14). A cabinet (36) is movable to extend in closing relation with the opening and to be disposed away from the opening. A door (46) including a transparent panel (50) is movable to close both a cabinet opening (42) and the housing opening (14). Items stored in the cabinet area are viewable through the door with the door in a cabinet closed position. The door is movable to enable access to items stored in the cabinet. The cabinet is movable to access items in a storage area normally behind the cabinet.

23 Claims, 5 Drawing Sheets

REFRIGERATOR

CROSS REFERENCE TO RELATED APPLICATIONS

This Application claims benefit of U.S. Provisional Application Ser. No. 62/175,537 filed Jun. 15, 2015, the disclosure of which is incorporated herein by reference in its entirety.

TECHNICAL FIELD

Exemplary embodiments relate to refrigerators. Specifically, an exemplary embodiment relates to a refrigerator with an internal display cabinet which enables viewing selected items through an outer door of the refrigerator.

BACKGROUND

Refrigerators are designed to be primarily utilitarian articles for keeping food and other items below ambient temperatures. While refrigerators generally are made to have a pleasing external appearance, the aesthetics associated with the refrigerator are not of primary importance to the refrigerator construction. Also, generally refrigerators have opaque walls and doors which prevent viewing of the contents of the refrigerator from the outside unless the refrigerator door is open.

Refrigerators may benefit from improvements.

SUMMARY OF THE DISCLOSURE

Exemplary embodiments include a refrigerator which provides pleasing aesthetics as well as functional properties. Persons sometimes acquire prized food items that require or benefit from being kept cool. This may include, for example, certain wines, beers or other exotic beverage items. Other prized food items may include certain vegetables, herbs, mushrooms or other items that it may be desirable to view and/or display.

Exemplary embodiments include a refrigerator with an integral display cabinet and a transparent door. The exemplary refrigerator further includes a storage area separate from the internal area of the cabinet. The exemplary refrigerator is configured such that items that are stored in the cabinet area can be viewed through a transparent panel in the refrigerator door. This enables prized food items to be visible from outside the refrigerator through the door.

In an exemplary embodiment the door and cabinet are movably mounted to the refrigerator housing through a double hinge arrangement. The door can be opened to access items in the cabinet area. With the door open the cabinet can be moved outwardly supported through the double hinge arrangement away from the opening to the housing. This enables a user to access the inside area of the refrigerator that is outside of the cabinet area. Because the cabinet in a closed position generally prevents light from reaching the storage area behind it, the storage area behind the cabinet is suited for items that may benefit from not being exposed to light.

The exemplary embodiments provide for an attractive display of refrigerated items within the cabinet area that can be viewed through the transparent panel of the door when closed, and which can be readily accessed. Other items in the storage area behind the cabinet can also be readily accessed as needed by moving the cabinet. Numerous different alternative configurations may be utilized to provide the described beneficial functions and aesthetically pleasing arrangements.

DETAILED DESCRIPTION

Figure 1:
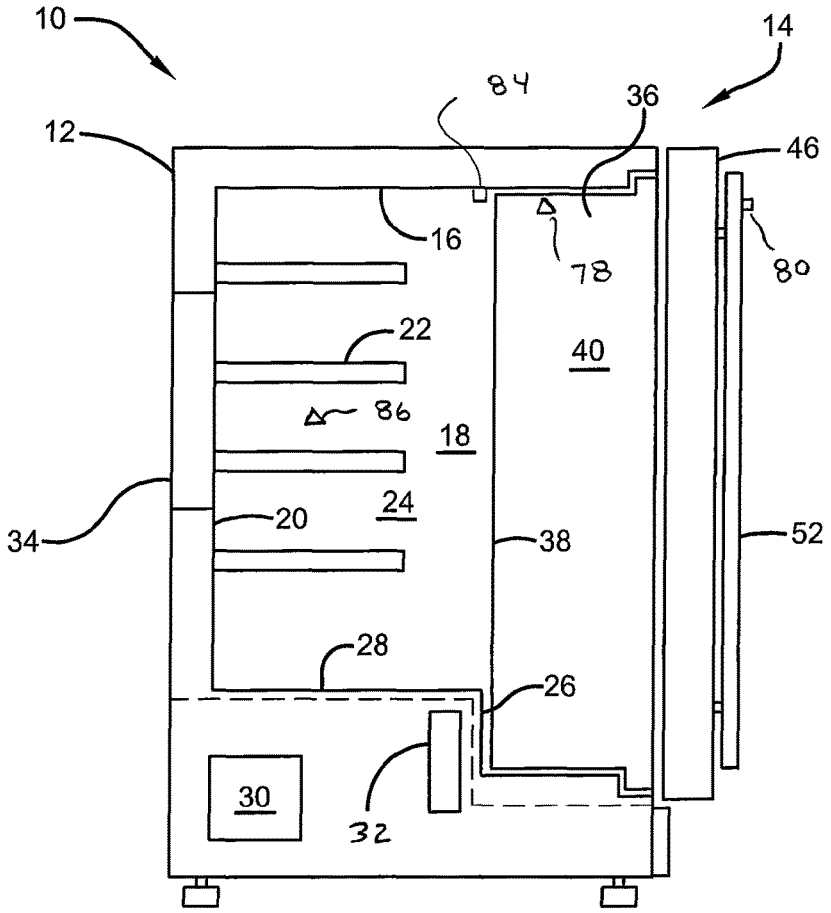
FIG. 1 is a sectional side view of an exemplary embodiment of a refrigerator.
Figure 2:
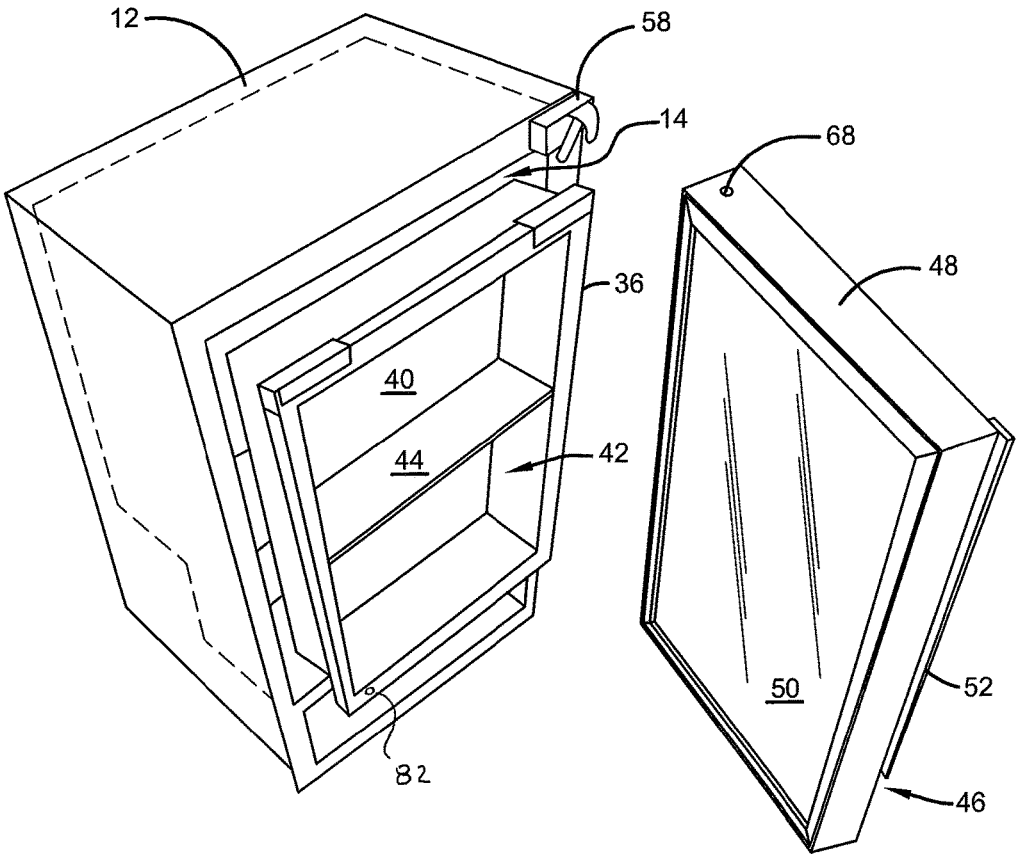
FIG. 2 is an isometric exploded view of the exemplary refrigerator including the housing, cabinet and door components.

Referring now to the drawings and particularly to FIG. 1, there is shown therein a cross-sectional view of a refrigerator generally indicated 10. In the exemplary embodiment the refrigerator is configured to be an under counter type refrigerator suitable for holding beers, wines and other beverages. Of course, this configuration is exemplary and in other embodiments, other refrigerator configurations used for purposes of holding other item types may be utilized.

The exemplary refrigerator includes a housing 12. Housing 12 is a rectangular box-shaped housing that is closed on five sides. The housing has a front housing opening 14. The housing includes an internal liner 16. The liner bounds a chilled area 18 within the housing. The liner bounding the chilled area includes a back wall 20. A plurality of shelves 22 extend in a back storage area 24. For reasons later discussed, the back storage area of the exemplary embodiment is best suited for storing food items that may benefit from not being exposed to light. However, as can be appreciated, the back storage area may be used for storing numerous types of items that are desirably kept chilled.

In the exemplary embodiment the liner further includes a forward wall 26. Forward wall 26 is a generally vertically extending wall that extends only a portion of the total internal height of the chilled area. Wall 26 is an integral part of the liner that is positioned intermediate of the back wall 20 and the housing opening 14. A horizontal wall 28 of the liner extends between the back wall 20 and the top of the forward wall 26.

In the exemplary arrangement, the refrigerator includes heat transfer components within the housing. In an exemplary arrangement, the refrigerator includes a system for removing heat from the chilled area 18 through use of a working fluid such as a refrigerant material. The exemplary arrangement includes a compressor which pumps the working fluid into a heat exchanger from which it releases heat to the area outside the housing. The working fluid is directed to a condenser where the working fluid is condensed to a liquid. One or more expansion valves are used to expand the working fluid. These components are represented by a mechanical package schematically indicated 30. The working fluid is expanded in an evaporator 32 and another evaporator 34. In the evaporators as the working fluid expands and evaporates, the fluid absorbs heat cooling the chilled area 18. After leaving the evaporators, the working fluid is returned to components of the mechanical package 30 to repeat the cycle.

In the exemplary arrangement, evaporator 32 is positioned in close proximity to the forward wall 26. This facilitates the cooling effect in proximity to the forward wall which is desirable for reasons later discussed. The evaporator 34 is positioned adjacent to the back wall 20. The evaporator 34 is operative to chill the area of the back wall and the back storage area 24 adjacent thereto. Of course it should be understood that the placement of the evaporators and the types of components included in the mechanical package is exemplary and in other arrangements, other approaches may be used.

Further while in the exemplary embodiment, the evaporators 32 and 34 operate as cooling devices for removing heat from the areas adjacent thereto, in other arrangements, other types of cooling devices may be used. These include, for example, electronic cooling devices. Such electronic cooling devices may include Peltier devices which provide cooling in response to electrical power. In other arrangements, other types of cooling devices may be used.

The exemplary refrigerator further includes a cabinet 36. The cabinet 36 is configured to substantially close the opening 14 in the housing 12. The exemplary cabinet includes an opaque cabinet back wall 38. The cabinet 36 is configured such that in the position of the cabinet closing the housing, the back wall 38 is positioned in close adjacent relation with the forward wall 26 and the evaporator 32. In the exemplary arrangement, the cabinet bounds a cabinet area 40. Cabinet area 40 is accessible through a cabinet opening 42 at the front thereof. A plurality of shelves 44 are positioned in the exemplary cabinet area for supporting items thereon.

In the exemplary arrangement shown in FIG. 1, the cabinet 36 is sized so that when it is positioned within the opening 14 of the housing it generally fully closes the housing opening 14. Further in the exemplary arrangement, the cabinet opening 42 when in the housing closed position of the cabinet extends generally flush and in the same plane as the housing opening 14. Of course this arrangement is exemplary and in other embodiments, other approaches may be used.

The exemplary refrigerator further includes a door 46. Door 46 of the exemplary embodiment includes a rectangular frame 48. Frame 48 of the exemplary door 46 is comprised of a generally rigid material such as aluminum or stainless steel. The frame 48 extends in surrounding relation of a transparent panel 50. The transparent panel 50 enables viewing food items in the cabinet area 40 through the door. The exemplary panel may limit the transmission of UV light or other radiation which may harm the food items expected to be held in the cabinet area. The exemplary door 46 further includes an external handle 52. The handle 52 is configured for facilitating manual engagement of the door for purposes of opening and closing it. The exemplary door may also include a resilient gasket or similar structure that surrounds the housing opening and bridges any gaps between the housing and the door in the closed position. As can be appreciated from FIG. 1, the exemplary door 46 is sized such that in the closed position when the door is adjacent to the opening 14 of the housing and the cabinet opening 40, the door is configured to close both the cabinet opening and the housing opening. Of course it should be understood that this arrangement is exemplary and in other arrangements, other approaches may be used.

In the exemplary embodiment, the refrigerator 10 includes a pair of lateral side walls 54 and 56. The lateral side walls extend generally vertically when the refrigerator is in its operative position. In the exemplary embodiment positioned adjacent to one lateral side wall 56 are a pair of double hinges 58 and 60. In the exemplary arrangement, double hinges 58 and 60 are mirror images of one another. Double hinge 58 is positioned relative to the housing adjacent to the top of side wall 56 while double hinge 60 is positioned adjacent to the bottom of side wall 56.

Of course it should be appreciated that the hinge arrangement of this exemplary embodiment is a right-hand type hinge arrangement where the door 46 and the cabinet 36 open in with the door swinging left to right. In other arrangements, the hinges may be positioned adjacent the opposite side wall. In this alternative arrangement, the handle 52 can be positioned on the opposite side of the door. In some arrangements this can be achieved by inverting the door such that the handle is positioned on the right side of the refrigerator when viewed from the front and the door will open swinging from right to left. Exemplary arrangements may readily accommodate both configurations such as by having multiple suitable mounting holes that can be closed by plugs when not in use so as to provide a refrigerator construction that can be used in numerous different positions so as to provide the most favorable access to and/or viewing of the cabinet interior.

Figure 3:
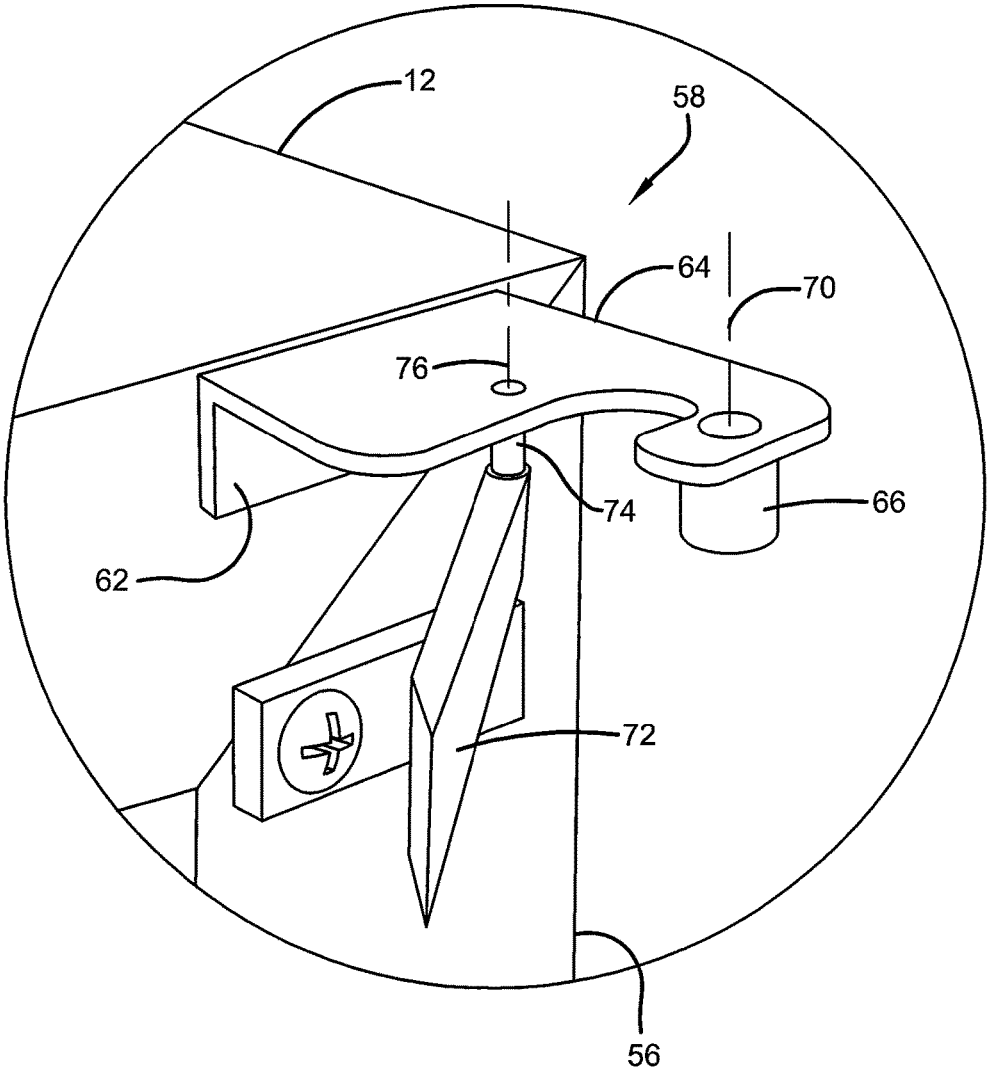
FIG. 3 is an enlarged view of a double hinge utilized in an exemplary embodiment.

The structure of the exemplary double hinge used for operatively supporting both the door 46 and the cabinet 48 in movable supported connection with the housing, is shown in greater detail in FIG. 3. The exemplary double hinge includes a first leg 62. Leg 62 is configured for attachment to a vertically extending face of the housing 12 which bounds the opening 14. Leg 62 is configured for attachment to the housing by fasteners such as screws which are not separately shown. The exemplary double hinge further includes a second leg 64. Leg 64 extends generally horizontally and outward from the housing 12 in the installed position. Leg 64 has in connection therewith a door supporting guide pin 66. Door supporting guide pin 66 is configured to engage in an aperture 68 which extends in the door frame 48. The engagement of the pin 66 in the aperture 68 constrains the door to rotate about an axis 70.

Figure 4:
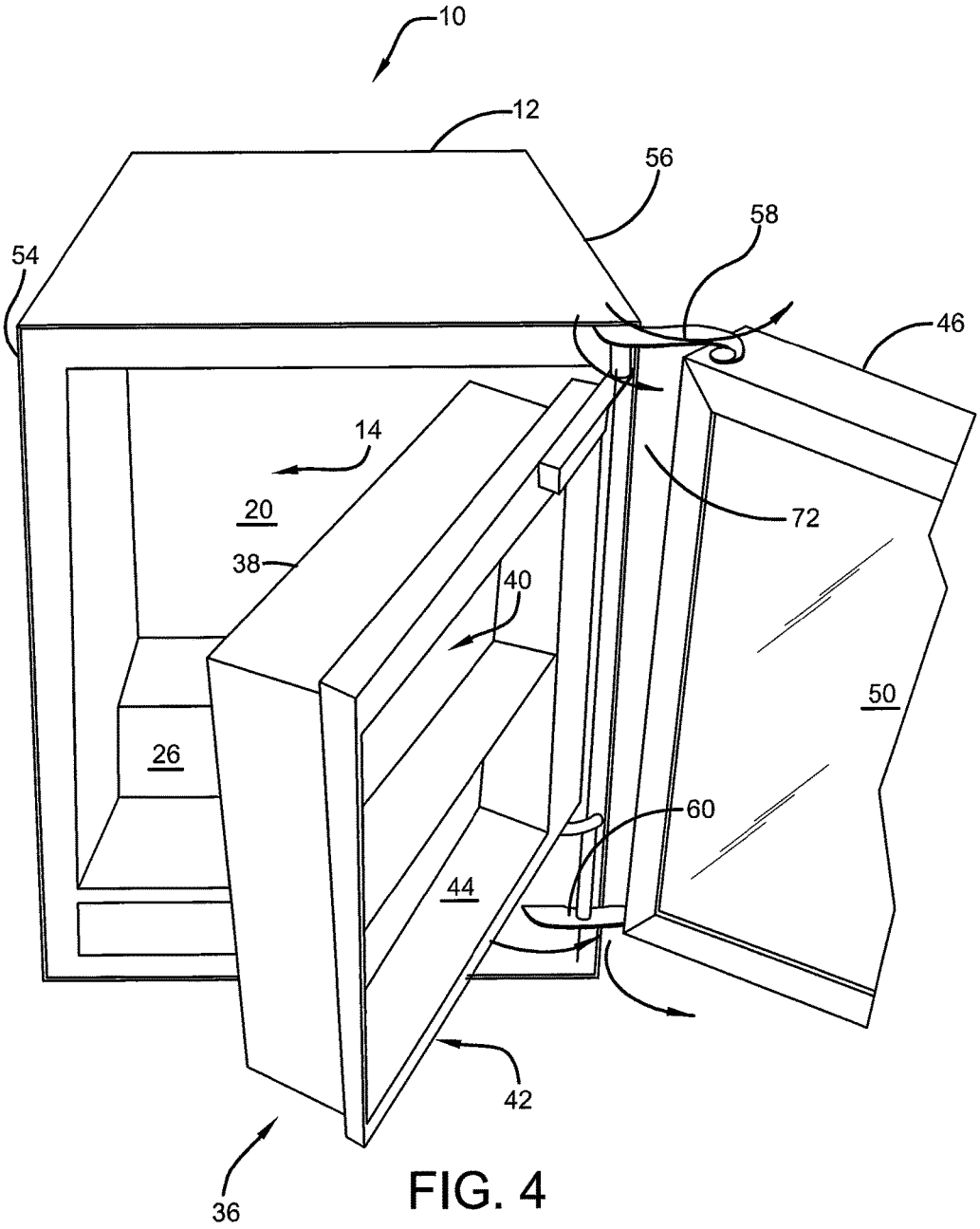
FIG. 4 is an isometric view representing movement of the door and cabinet structures relative to the refrigerator housing in supported connection with the double hinges.
Figure 5:
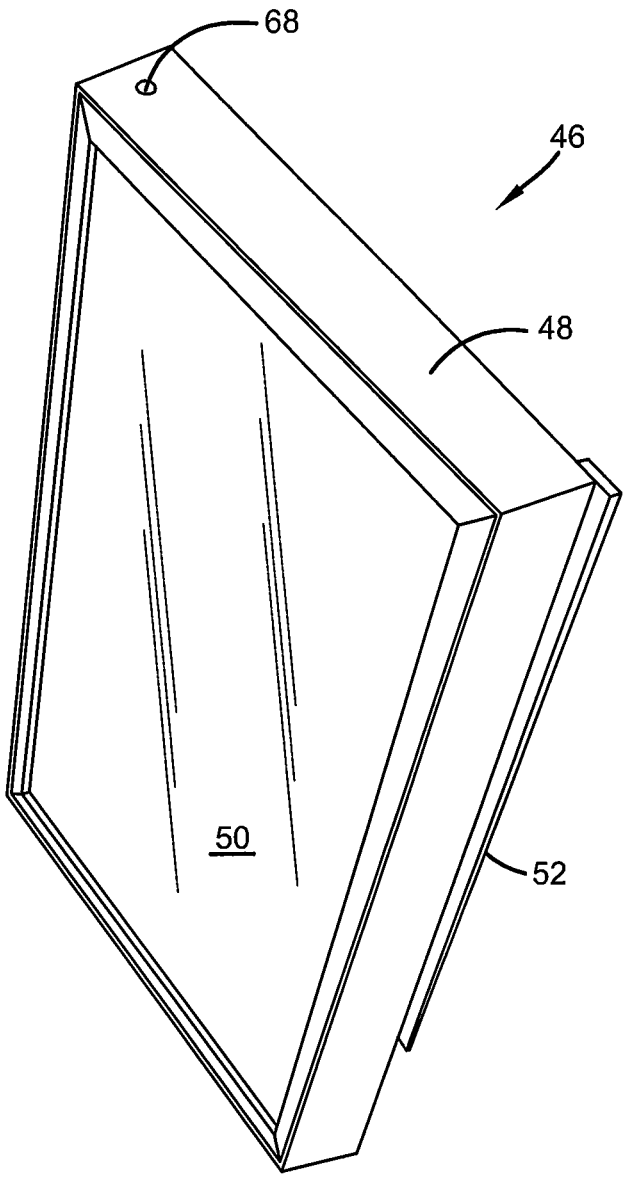
FIG. 5 is an isometric back view of a door of an exemplary refrigerator embodiment.

Double hinge 58 further includes a rotatable cabinet support 72. Cabinet support 72 is in operative movable connection with a pin 74. Pin 74 is attached to leg 64 of the double hinge and constrains the cabinet support 72 to rotate about an axis 76. As represented in FIG. 4, the exemplary cabinet support 72 is configured to attach to a front face of the cabinet bounding the cabinet opening 42.

As previously discussed, in the exemplary embodiment the lower double hinge 60 is the mirror image of the upper double hinge 58. Thus when the door is in engaged relation with the upper and lower double hinges, the door is constrained by the pair of hinges to rotate about axis 70. Likewise the cabinet 36 when engaged with the cabinet supports 72 of the hinge pair is configured to rotate about axis 76. In the exemplary arrangement, the axis 70 is disposed further laterally outward relative to the housing opening compared to axis 76, as well as further outward relative to the housing opening. This enables the door to be fully opened without interfering with movement of the cabinet. Further in the exemplary arrangement with the door open, the cabinet can be readily moved in operatively supported connection with the pair of double hinges without interfering with the door.

In the exemplary arrangement, the cabinet can be moved in operatively supported connection with the pair of hinges between a housing closed position in which the cabinet closes the housing opening 14, and a housing open position in which the cabinet is disposed away from the opening. The door is movable from a cabinet closed position in which the door closes the cabinet opening 42 and the housing opening 14, to a cabinet open position in which the door is disposed away from the cabinet opening and the housing opening.

In the exemplary embodiment, persons who wish to display food items such as valued wines, craft beers and the like, may place them for display in the shelves 44 of the cabinet area 40. With the door in the cabinet closed position, such items may be viewed through the transparent panel 50 of the door. In exemplary arrangements, lights 78 may be provided in the cabinet area which can illuminate the items so as to facilitate viewing through the door. For example in some exemplary arrangements, an external button switch or similar switch 80 may be provided so that a user can selectively illuminate lights in the cabinet area so that the items therein can be more readily viewed. Alternatively in other embodiments, other arrangements may be made for illuminating lights in the cabinet area. For example, the transparent panel 50 may include capacitance sensors or other sensors in a plurality of different disposed areas of the panel. This may include, for example, generally transparent metal films used with capacitance sensing circuitry or other suitable switches which can be utilized for purposes of determining an area in which a user's fingers have contacted the panel. An array of lights in the cabinet area may be selectively illuminated based on the area of contact by the user's hand with the overlying transparent panel. This may enable the user to selectively illuminate areas of the cabinet area to view items in selected portions thereof. Of course, these approaches to selectively illuminating the cabinet area are exemplary.

Further in exemplary embodiments, fans or other air moving devices may be utilized to assure air movement adjacent the inside surface of the transparent panel when the door is closed so as to avoid the formation of frost thereon which may impede viewing of the items in the cabinet area. Of course it should be understood that these approaches are exemplary. In other embodiments, other approaches may be used.

In the exemplary refrigerator, a user may move the door to the cabinet open position by grasping the handle to access items stored in the cabinet area 40. In the exemplary arrangement, when the door 46 is opened, a sensor 82 is operative to sense the open condition. In response to sensing the open condition, the switch 80 may cause the lights 78 in the cabinet area to illuminate. If the user desires only items within the cabinet area, the user may then close the door so as to close both the cabinet opening 42 and the housing opening 14. Closing the door causes the switch 82 to shut off the lights 78 in the cabinet area. Alternatively or in addition, if the user wishes to take items from the back storage area 24, after first moving the door to the cabinet open position, the user may then move the cabinet in supported connection with the pair of double hinges so as to move the cabinet from the housing closed position to the housing open position. Once the cabinet swings outward, the user can access items in the back storage area 24 previously behind the cabinet from outside the housing and remove those items from the refrigerator. A switch 84 is operative to detect that the cabinet has been moved outwardly. The switch 84 causes lights 86 in the back storage area 24 to illuminate. The illumination in the back storage area is sufficient to allow the user to find the items therein that they desire. The user can then return the cabinet 36 to the housing closed position. The switch 84 detects the cabinet in the closed position and causes the lights 86 to no longer be illuminated. Once the cabinet is in the housing closed position, the door can then be returned to the cabinet closed position, wherein the door closes both the cabinet opening and the housing opening.

In the exemplary arrangement, the position of the evaporator 32 adjacent to the forward wall 26 of the cabinet 36 in the housing closed position thereof facilitates cooling items in the cabinet area. Positioning of the cooling device at the base of the cabinet provides more enhanced cooling for the cabinet area than may be achieved by having only the single cooling device such as evaporator 34 disposed away from the back wall of the cabinet. Of course it should be understood that this arrangement is exemplary and in other arrangements, other approaches may be used to assure adequate cooling for items to be held in the cabinet area.

Thus the exemplary embodiments provide a suitable refrigerator for storing food items that are optimally kept below ambient temperature and for providing the capability to display such items so that they can be viewed from outside the refrigerator. Further the exemplary embodiment provides a large transparent panel such that numerous different items can be viewed in the cabinet area. This enables displaying a larger selection of the items that the user wishes to display. In addition the exemplary arrangement provides for a storage area behind the cabinet for holding items that may benefit by not being exposed to light or which the user of the refrigerator prefers to not have viewed through the transparent panel. Of course numerous other configurations employing the principles described herein may be utilized in other embodiments.

Thus the elements, features and characteristics of the embodiments described achieve desirable results, eliminate difficulties encountered in the use of prior devices and systems, solve problems and attain one or more useful objectives as stated above.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations given herein are by way of examples and the useful features are not limited to the exact details shown and described.

Further the descriptions which refer to left/right, top/bottom or similar terms indicating relative locations of items shall not be deemed limiting, and it will be understood that exemplary embodiments can be configured and used in numerous different orientations.

Having described the features, discoveries and principles of the exemplary embodiments, the manner in which they are constructed, operated and utilized, and the advantages and useful results attained, the new and useful structures, devices, elements, arrangements, parts, combinations, systems, equipment, operations, methods, processes and relationships are set forth in the appended claims.

I claim:

1. A refrigerator comprising:

a housing, wherein the housing bounds a chilled area, wherein the housing includes an opening, wherein the chilled area is accessible through the housing opening, a cabinet, wherein the cabinet bounds a cabinet area, wherein the cabinet area is accessible on a front side of the cabinet through a cabinet opening, and is closed on a back side opposed of the front side by an opaque back side wall, is configured to extend in the chilled area and to close the housing opening, is movably mounted in operatively supported connection with the housing, wherein the cabinet is movable between a housing closed position in which the cabinet closes the housing opening, and a housing open position in which the cabinet is disposed away from the housing opening, a door, wherein the door includes a transparent panel, is movably mounted in operatively supported connection with the housing, is configured to close the cabinet opening, is movable between a cabinet closed position in which with the cabinet in the housing closed position, the door in the cabinet closed position closes the cabinet opening and at least some contents of the cabinet area are visible through the transparent panel, and a cabinet open position in which with the cabinet in the housing closed position, the door is disposed away from the cabinet opening, wherein with the door in the cabinet open position the cabinet is movable between the housing closed position and the housing open position, wherein with the door in the cabinet open position and the cabinet in the housing closed position the back side wall prevents access through the cabinet opening to a back area of the chilled area that is disposed inwardly of the cabinet, wherein the back area includes any of the chilled area that is disposed inwardly of the back side wall of the cabinet in the housing closed position, and visibility of the back area through the cabinet opening, wherein with the door in the cabinet open position and the cabinet in the housing open position, the back area is accessible through the housing opening.

2. The refrigerator according to claim 1, wherein the door is in operative connection with at least one manually actuatable switch that is externally actuatable on the door, and wherein the cabinet area includes at least one light, and wherein with the door in the cabinet closed position, manual actuation of the at least one switch is operative to illuminate the at least one light in the cabinet area.

3. The refrigerator according to claim 1, wherein the chilled area is bounded by a chilled area back wall on a side of the chilled area opposed of the housing opening, wherein the chilled area further includes a vertically extending forward wall positioned intermediate of the housing opening and the chilled area back wall, wherein in the housing closed position, the back wall of the cabinet is in immediate adjacent relation with the forward wall, and at least one of an evaporator or an electronic cooling device is positioned in the housing and adjacent the forward wall such that the forward wall is intermediate of the back wall of the cabinet and the at least one of the evaporator or the electronic cooling device.

4. A refrigerator comprising:

a housing, wherein the housing bounds a chilled area, wherein the housing includes a housing opening, wherein the chilled area is accessible from outside the housing through the housing opening, a cabinet, wherein the cabinet bounds a cabinet area, includes at least one light in the cabinet area, wherein the cabinet area is accessible on a front side through a cabinet opening, is configured to extend in the chilled area and to close the housing opening, is movably mounted in operatively supported connection with the housing, wherein the cabinet is movable between a housing closed position in which the cabinet closes the housing opening, and a housing open position in which the cabinet is disposed away from the housing opening, a door, wherein the door, includes a transparent panel, wherein the transparent panel includes a transparent outer surface, at least one manually actuatable switch externally accessible on the transparent outer surface, wherein the at least one manually actuatable switch is in operative connection with the at least one light, is movably mounted in operatively supported connection with the housing, is configured to close the cabinet opening, is movable between a cabinet closed position in which the door closes the cabinet opening, and a cabinet open position in which the door is disposed away from the cabinet opening, wherein in the cabinet closed position the cabinet area is visible through the transparent outer surface of the transparent panel, and selective manual actuation of the at least one manually actuatable switch on the outer surface is operative to cause the cabinet area to be illuminated by the at least one light.

5. The refrigerator according to claim 4, wherein the transparent panel includes a plurality of disposed manually actuatable switches, wherein selective manual actuation of a first switch causes a corresponding first area of the cabinet area corresponding to a position of the first switch to be illuminated by the at least one light therein.

6. The refrigerator according to claim 4, wherein the housing includes a pair of disposed vertically extending outside lateral side walls, a pair of double hinges mounted in fixed operative connection with the housing adjacent one lateral side wall, wherein one of the pair of double hinges is adjacent a top of the one lateral side wall and the other of the double hinges of the pair is adjacent a bottom of the one lateral side wall, wherein the door and the cabinet are each in operative attached connection with the pair of double hinges, wherein the door is rotatable in operative connection with each of the hinges about a first vertical axis and the cabinet is rotatable in operative connection with each of the hinges about a second vertical axis disposed from the first vertical axis.

7. A refrigerator comprising:

a housing, wherein the housing bounds a chilled area, wherein the housing includes a housing opening, wherein the chilled area is accessible from outside the housing through the housing opening, wherein the chilled area is bounded by a vertically extending chilled area back wall, wherein the chilled area back wall is opposed of the housing opening, wherein at least one back area evaporator or electronic cooling device is positioned in the housing adjacent to the chilled area back wall, wherein at least one other evaporator or electronic cooling device is positioned in the housing intermediate of the chilled area back wall and the housing opening, a cabinet, wherein the cabinet bounds a cabinet area, wherein the cabinet area is accessible on a front side through a cabinet opening, is configured to extend in the chilled area and to close the housing opening, is movably mounted in operatively supported connection with the housing, wherein the cabinet is movable between a housing closed position in which the cabinet closes the housing opening, and housing open position in which the cabinet is disposed away from the housing opening, wherein in the housing closed position the cabinet is closer to the at least one other evaporator or electronic cooling device than the at least one back area evaporator or electronic cooling device, a door, wherein the door is movably mounted in operatively supported connection with the housing, is configured to close the cabinet opening, is movable between a cabinet closed position wherein the door closes the cabinet opening when the cabinet is in the housing closed position, and a cabinet open position, wherein with the door in the cabinet open position the cabinet is movable between the housing closed position and the housing open position.

8. The refrigerator according to claim 7 wherein the chilled area is bounded by a vertically extending wall intermediate of the chilled area back wall and the housing opening, wherein in the housing closed position of the cabinet, the vertically extending wall is intermediate of the cabinet area and the at least one other evaporator or electronic cooling device.

9. A refrigerator comprising:

A refrigerator comprising:

a housing, wherein the housing bounds a chilled area, wherein any portion of the chilled area is externally accessible from outside the housing only through a single housing opening, a cabinet, wherein the cabinet bounds a cabinet area and the cabinet area is accessible through a cabinet opening, wherein the cabinet is configured to extend in the chilled area and to fill the housing opening, wherein the cabinet is movably mounted in operatively supported connection with the housing and is movable between a housing closed position in which the cabinet closes the housing opening, and a housing open position in which the cabinet is disposed away from the housing opening, a door, wherein the door is configured to close the cabinet opening and the housing opening, and the door is movably mounted in operatively supported connection with the housing, wherein the door is movable between a cabinet closed door position in which the door closes both the cabinet opening and the housing opening, and a cabinet open door position in which the door is disposed away from the cabinet opening and the housing opening, wherein in the cabinet open door position the cabinet is movable between the housing closed position and the housing open position.

10. A refrigerator comprising:

a housing, wherein the housing bounds a chilled area, wherein the housing includes a housing opening, wherein the chilled area is accessible from outside the housing through the housing opening, a cabinet, wherein the cabinet bounds a cabinet area, includes a plurality of disposed lights in the cabinet area, wherein the cabinet area is accessible on a front side through a cabinet opening, is configured to extend in the chilled area and to close the housing opening, is movably mounted in operatively supported connection with the housing, wherein the cabinet is movable between a housing closed position in which the cabinet closes the housing opening, and a housing open position in which the cabinet is disposed away from the housing opening, a door, wherein the door, includes a transparent panel, wherein the transparent panel includes a transparent outer surface, wherein a plurality of disposed manually actuable switches are externally accessible on the transparent outer surface, wherein each respective switch of the plurality of switches is in operative connection with a corresponding respective one of the plurality of lights, wherein each of the plurality of switches is manually actuable by finger contact with the transparent outer surface of the transparent panel, is movably mounted in operatively supported connection with the housing, is configured to close the cabinet opening, is movable between a cabinet closed position in which the door closes the cabinet opening, and a cabinet open position in which the door is disposed away from the cabinet opening, wherein in the cabinet closed position the cabinet area is visible through the transparent outer surface of the transparent panel, and wherein finger contact with a respective switch causes a respective area of the cabinet area corresponding to a position of the respective switch to be illuminated.

11. The refrigerator according to claim 10, wherein the door is configured such that in the cabinet closed position, the door closes both the housing opening and the cabinet opening.

12. The refrigerator according to claim 11, wherein the housing includes a pair of disposed, vertically extending outside lateral side walls, and further including:

a pair of double hinges mounted in operative fixed connection with the housing adjacent one lateral side wall, and wherein one of the pair of double hinges is adjacent a top of the one lateral side wall and the other of the double hinges of the pair is adjacent the bottom of the one lateral side wall, wherein the door and the cabinet are each in operatively attached connection with the pair of double hinges, wherein the door is rotatable in operative connection with each hinge about a first vertical axis and the cabinet is rotatable in operative connection with each hinge about a second vertical axis that is disposed from the first vertical axis.

13. The refrigerator according to claim 12, wherein the first vertical axis is disposed further outward relative to the housing opening than the second vertical axis.

14. The refrigerator according to claim 12, wherein the transparent panel includes an inside face, wherein the cabinet opening is disposed in facing relation of the inside face of the transparent panel when the door is in the cabinet closed position, and wherein at least some contents of the cabinet area are visible through the door.

15. The refrigerator according to claim 14, wherein in the housing closed position the cabinet opening and the housing opening extend in a common plane.

16. The refrigerator according to claim 15, wherein the chilled area is bounded inwardly by an inside housing back wall disposed inward from the housing opening wherein the inside back wall extends vertically, and wherein in the housing closed position a back storage area is intermediate of the cabinet back wall and the inside housing back wall.

17. The refrigerator according to claim 16, wherein the chilled area includes a forward wall, wherein the forward wall extends vertically and is disposed toward the housing opening relative to the back wall, and wherein in the housing closed position, the cabinet back wall is in close adjacent relation to the forward wall.

18. The refrigerator according to claim 17, wherein the refrigerator further includes a first cooling device, wherein the first cooling device is positioned in the housing and adjacent the forward wall.

19. The refrigerator according to claim 18, wherein the refrigerator further includes a second cooling device, wherein the second cooling device is positioned in the housing and adjacent the inside housing back wall.

20. The refrigerator according to claim 19, wherein the first and second cooling devices include at least one of an evaporator and electronic cooling device.

21. The refrigerator according to claim 17, and further including a horizontal wall bounding the chilled area, wherein the horizontal wall extends horizontally and intermediate of the forward wall and the inside housing back wall, wherein the horizontal wall bounds the back storage area.

22. The refrigerator according to claim 21, wherein the door includes a frame, wherein the frame extends in surrounding relation of the transparent panel, wherein each of the pair of double hinges is in operative connection with the frame.

23. The refrigerator according to claim 22, and further including a plurality of cabinet shelves in the cabinet area and a plurality of housing shelves in the back storage area.

* * * * *